US007959781B2

(12) United States Patent
Lee et al.

(10) Patent No.: US 7,959,781 B2
(45) Date of Patent: Jun. 14, 2011

(54) APPARATUS AND METHOD FOR MANUFACTURING CARBON NANO-TUBE PROBE BY USING METALLIC VESSEL AS AN ELECTRODE

(75) Inventors: Younghee Lee, Gyonggiy-do (KR); Hakyu Choi, Seoul (KR); Seongchu Lim, Gyonggiy-do (KR)

(73) Assignee: Sungkyunkwan University Foundation for Corporate Collaboration, Suwon (KR)

( * ) Notice: Subject to any disclaimer, the term of this patent is extended or adjusted under 35 U.S.C. 154(b) by 1174 days.

(21) Appl. No.: 11/648,033

(22) Filed: Dec. 29, 2006

(65) Prior Publication Data

US 2008/0000773 A1 Jan. 3, 2008

(30) Foreign Application Priority Data

Dec. 31, 2005 (KR) ..... 10-2005-0136241

(51) Int. Cl.
*B01D 57/02* (2006.01)

(52) U.S. Cl. ..... 204/547

(58) Field of Classification Search ..... 204/471, 204/477, 547

See application file for complete search history.

(56) References Cited

U.S. PATENT DOCUMENTS 7,014,743 B2 * 3/2006 Zhou et al. ..... 204/547

OTHER PUBLICATIONS

Kulawik et al. ("A double lamellae dropoff etching procedure for tungsten tips attached to tuning fork atomic force microscopy/scanning tunneling microscopy sensors," Review of Scientific Instruments, vol. 74, Issue 2, pp. 1027-1030, 2003).*

Young Hee Lee; *Synthesis and Applications of Carbon Nanotubes*; Carbon Science, Technical Review; vol. 2; No. 2; (2001); pp. 120-141 (Including English translation of relevant portions).

Jie Tang; Assembly of 1D Nanostructures into Sub-micrometer diameter Fibrils with Controlled and Variable Length by Dielectrophoresis; Advanced Materials; 2003; 15; No. 16; p. 1352-55.

* cited by examiner

*Primary Examiner* — Luan V Van

(74) *Attorney, Agent, or Firm* — Edwards Angell Palmer & Dodge LLP; Kongsik Kim

(57) ABSTRACT

The present invention provides an apparatus for manufacturing a carbon nano-tube tip comprising an AC/DC voltage supply, a metallic or semiconductor tip, an amperemeter, and a metallic vessel connected to the tip and the amperemter, wherein the metallic vessel is used as the electrode and define a groove therein filled with a carbon nano-tube solution. The present invention also provides a method for manufacturing a carbon nano-tube tip wherein carbon nano-tubes dispersed in a solvent are attached by electrophoresis to the end of a metal tip or semiconductor tip by using as an electrode a metallic vessel having a groove therein.

9 Claims, 5 Drawing Sheets

Prior Art

Prior Art

APPARATUS AND METHOD FOR MANUFACTURING CARBON NANO-TUBE PROBE BY USING METALLIC VESSEL AS AN ELECTRODE

CROSS-REFERENCE TO RELATED APPLICATION

The present application claims, under 35 U.S.C. §119(a), the benefit of the filing date of Korean Patent Application No. 10-2005-0136241 filed on Dec. 31, 2005, the entire contents of which are hereby incorporated by reference.

BACKGROUND OF THE INVENTION

1. Field of the Invention

The present invention relates to an apparatus and a method for manufacturing a carbon nano-tube tip. More particularly, the present invention provides an apparatus comprising a metallic vessel used as an electrode. The present invention provides a method comprising dropping a carbon nano-tube solution into the groove.

2. Background Art

A carbon nano-tube has a diameter of less than 1 μm which is smaller than that of a carbon fiber. Although there is no sharp line between carbon nano-tubes and carbon fibers, one narrow definition is that materials in which one face of carbon having a hexagon mesh is nearly parallel to the axis are referred to as carbon nano-tubes. Carbon nano-tubes include variant nano-tubes in which amorphous carbon is present around the carbon nano-tubes.

Generally, under the narrow definition, carbon nano-tubes are classified into two groups; (1) single-walled nanotubes ("SWNT") which have one structure with a single hexagon mesh tube (grapheme sheet) and (2) multi-walled nanotubes ("MWNT") which are comprised of multiple layers of graphene sheets. Since carbon nano-tubes have a diameter smaller than that of carbon fibers, a high Young's modulus, low work function, high heat conductivity, high chemical stability and high electrical conductivity, they have received much attention as a new industrial material.

Carbon nano-tubes are new materials made of only carbon atoms as a constituent and have Young's modulus of 1 Tpa or higher. Furthermore, since carbon nano-tubes are ballistic conductors, they can conduct a very large current, 109 A/cm$^2$. Also, as carbon nano-tubes have a high aspect ratio, they can be used as a field electron emission source and they have been applied for the development of display or light emitting devices with high brightness. In addition, as some single-walled carbon nano-tubes show semiconductor properties, application to field effect transistor (FET) have been studied.

Carbon nano-tubes are thin and long enough to allow high accessibility to the target during manipulations. They can approach easily to the target without touching the adjacent object in a narrow space due to high aspect ratio. In addition, with high flexibility the carbon nano-tubes can prevent the target material from being damaged when tips are accidentally crashed on the target materials. With very high electrical conductivity, the carbon nano-tubes can be used as an electrode when researching electrical properties of the target material. Also, the high chemical stability of graphene sheets is one of the important properties that probe materials are supposed to have.

Conventionally, as a method for manufacturing carbon nano-tubes, electric arc discharge method was used. Recently, however, various methods have been attempted such as laser vapor deposition, pyrolysis vapor deposition, thermochemical vapor deposition, and plasma-enhanced chemical vapor deposition. As the carbon source in the said chemical vapor deposition, hydrocarbon gas such as acetylene, ethylene, methane, benzene and the like have been used and as catalytic metals, transition metals such as Ni, Co, Fe and so on or alloy thereof have been used.

Especially, if a solution containing catalytic metals is used for growing carbon nano-tubes, the catalytic metals are deposited on the substrate using ink-jet method, spray method, dipping method and the like and then dried the solution.

As a carbon nano-tube growth, the method of growing nano-tubes in vertical direction to the substrate, the method of growing carbon nano-tubes in the selected area by patterning catalytic metal on the substrate, and the method of growing carbon nano-tubes in the horizontal direction to use as an electronic device of nano size and the like have been suggested.

In electric arc discharge, a graphite rod as an anode and a cathode is engaged in arc discharge in an inert gas such as He, Ar and the like. As an anode includes Ni compounds, Fe compounds and rare-earth compounds, they can act as catalysts and synthesize single-walled carbon nano-tubes efficiently. However, as together with carbon nano-tubes, large amounts of amorphous carbon particles or graphite particles are simultaneously formed, they are all present in a form of mixture.

Laser vapor deposition synthesizes carbon nano-tubes by evaporating a specimen, which is made by mixing transition metals and graphite powder in a certain ratio inside the quartz tube with laser outside. Though such laser vapor deposition can synthesize carbon nano-tubes with considerably high purity, it has too low a productivity (Y. H. Lee et al., Carbon Science, "Synthesis and Applications of Carbon Nanotubes," Vol. 2, No. 2 (2001) p. 123).

Chemical vapor deposition method grows carbon nano-tubes by decomposing acetylene and methane gas and the like containing carbon. Since chemical vapor deposition depends on the chemical reaction occurring in the pyrolysis process of methane gas and the like as a source, carbon nano-tubes with high purity can be produced. However, the structure of the manufactured carbon nano-tubes was is defective and imperfect than those of the carbon nano-tubes by arc discharge and the like.

In the pyrolysis method, liquid or gas phase hydrocarbon is supplied to the reaction tube in which transition metals are heated and decompose hydrocarbon. Then, carbon nano-tubes are continuously synthesized (Y. H. Lee et al., p. 127). The size of the transition metal is reported to be the main factor determining the diameter of the carbon nano-tubes. The size of such transition metal crystal is determined by the diffusion rate of the decomposed transition metal atoms and the concentration of decomposed transition metal per unit volume concentrated in the reaction space. It is not easy to control such diffusion rate and concentration, however.

Development of a nano probe that has the diameter of nano meter size is essential to move or manipulate objects in nano meter dimensions. Accordingly, the development of a nano probe using a carbon nano-tube has been carried out. As a part of the development of such a nano probe, the first requirement is to properly align carbon nano-tubes on a supporting body.

To date, direct growth method which mounts a carbon nano-tube directly on the supporting stand with chemical vapor deposition; the method in which CNT/polymer composite was thermally heated and physically cracked and then the carbon nano-tubes projecting from the end side are used as a tip; the method in which each carbon nano-tube are attached using adhesives in SEM; and the method in which an electric beam is irradiated between the tip and the carbon nano-tube having amorphous carbon in SEM/TEM to fix them have been reported.

Of those methods, although direct growth method has superiority in adhesion between supporting stand and the carbon nano-tubes, it is difficult to control the direction of the carbon nano-tubes. Furthermore, since the method using CNT/polymer composite can end up with multiple tubes, using it as a probe may be inadequate in manipulating the target materials. The case using a manipulator in SEM/TEM has inferior adhesion strength and directionality because the nano-tubes are attached using adhesive and an electron beam. With the conventionally available electrophoresis, it is difficult to control the bundle size and the direction of the carbon nano-tubes in SEM/TEM. (Jie Tang et al., Advanced Material, "Assembly of 1D Nanostructure into Sub-Micrometer Diameter Fibrils with Controlled and Variable Length by Dielecrophoresis," Vol. 15(15) (2003))

FIG. 1 illustrates the use of a circular electrode for manufacturing carbon nano-tubes with electrophoresis. Since in the electrophoresis of the existing technique, the electric field is not aligned in one direction, but is diverged so that the distribution of the electric field is not focused, the angle between the tip and the surface of the organic solvent cannot be controlled so that the direction of the carbon nano-tubes at the end of the tungsten tip and the bundle of carbon nano-tubes cannot be controlled. FIG. 2 is a photograph showing the tip of the carbon nano-tubes manufactured according to electrophoresis of the existing technique of FIG. 1. As shown in FIG. 2, it can be recognized that the direction of the carbon nano-tubes at the end of the tungsten tip and the bundle of carbon nano-tubes is loosely formed.

Conventional methods for manufacturing a tip using carbon nano-tubes have problems in the direction of the carbon nano-tubes at the tip end, the diameter of each carbon nano-tube or bundle of carbon nano-tubes, the length of the attached carbon nano-tubes, adhesion strength of carbon nano-tubes and tip and the like.

The information disclosed in this Background of the Invention section is only for enhancement of understanding of the background of the invention and should not be taken as an acknowledgement or any form of suggestion that this information forms the prior art that is already known to a person skilled in the art.

BRIEF SUMMARY OF THE INVENTION

The present invention provides an improved method and apparatus that can solve the problems associated with such conventional techniques. More specifically, according to the present methods and apparatuses, gases or impurities can be prevented from being produced, the direction can be controlled by controlling the angle of the metallic vessel having the groove therein, tips and organic solvents having different volatilization temperatures can be used to control the length of carbon nano-tubes attached by controlling the time of electrophoresis.

In one aspect, the present invention provides an apparatus for manufacturing a carbon nano-tube tip comprising; (a) an AC/DC voltage supply for supplying AC and/or DC pulses; (b) a metallic or semiconductor tip which is biased by the voltage supply and has carbon nano-tubes at its end; (c) an amperemeter connected to said AC/DC voltage supply; and (d) a metallic vessel connected to the tip and the amperemter, wherein the metallic vessel is used as the electrode and define a groove therein filled with a carbon nano-tube solution.

In a preferred embodiment, the metallic vessel may be designed to have a diameter smaller than the depth of the vessel so as to be able to supply a uniform electric field during electrophoresis.

In another preferred embodiment, the metallic vessel can be in the form of a hemisphere or a cone.

In still another preferred embodiment, the carbon nano-tube solution may be prepared by using thin multi-wall carbon nano-tubes or single-walled, double-walled, or multi-wall carbon nano-tubes.

Preferred solvent to be used for preparing the carbon nano-tube solution includes: a non-aqueous solvent selected from the group consisting of DCE (1,2-dichloroethane), DMF (N,N-dimethylformamide), THF (tetrahydrofuran), NMP (N-Methyl pyrrolidone), acetone and isopropyl alcohol; or an aqueous solution containing a surfactant selected from the group consisting of ODA (octadecylamine), SDS (sodium-dodecylsulfate) and DNA (deoxyribonucleic acid).

In another aspect, the present invention provides a method for manufacturing a carbon nano-tube tip, wherein carbon nano-tubes dispersed in a solvent are attached by electrophoresis to the end of a metal tip or semiconductor tip by using as an electrode a metallic vessel having a groove therein.

In a further aspect, the present invention provides a method for manufacturing a carbon nano-tube tip comprising; (a) providing carbon nano-tubes in a metallic vessel to prepare a carbon nano-tube solution; (b) supplying AC and DC pulses to a metal or semiconductor tip using an AC/DC voltage supply; (c) placing the tip on the surface of the carbon nano-tube solution in the metallic vessel; and (d) controlling the angle between the tip and the surface of the carbon nano-tube solution.

According to the present invention, the electrode is minimized using the metallic vessel having a groove therein and the electric field is uniformly applied in all directions. The direction of carbon nano-tubes at the end of the tip can be controlled using the volatility and surface tension of the solvent in which carbon nano-tubes are well dispersed.

In a preferred method according to the present invention, a solution, in which carbon nano-tubes are dispersed, is first made before attaching carbon nano-tubes to the tip using electrophoresis. Secondly, metal tip used in electrophoresis is etched through the electrochemical method. Thirdly, carbon nano-tubes are attached to the said etched metal tip by electrophoresis using a metallic vessel having a small groove therein. Thereafter, the carbon nano-tube tip manufactured in the said process is subject to heat treatment for providing a stronger bondage.

BRIEF DESCRIPTION OF THE DRAWINGS

These, and other features and advantages of the invention, will become clear to those skilled in the art from the following detailed description of the preferred embodiments of the invention rendered in conjunction with the appended drawings in which like reference numerals refer to like elements throughout, and in which.

DETAILED DESCRIPTION OF THE INVENTION

Figure 1:
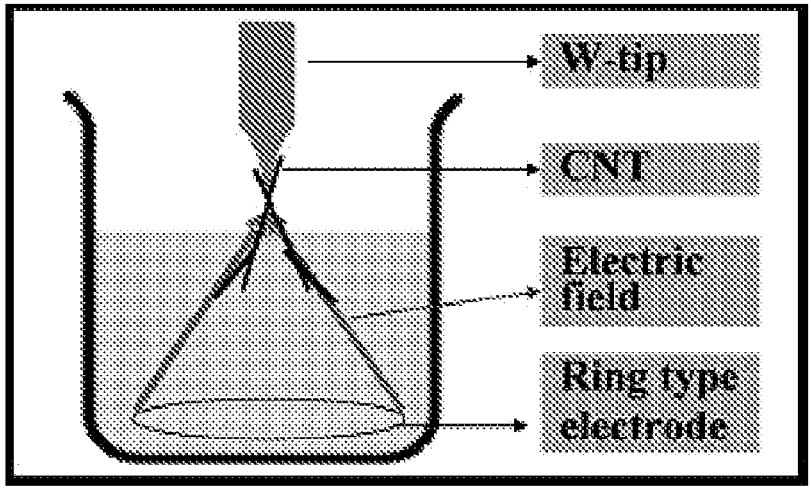
FIG. 1 is a schematic illustration of a conventional electrophoresis apparatus for manufacturing a carbon nano-tube tip using a flat circular electrode.

Reference will now be made in detail to the preferred embodiment of the present invention, examples of which are illustrated in the drawings attached hereinafter, wherein like reference numerals refer to like elements throughout. The embodiments are described below so as to explain the present invention by referring to the figures.

Figure 3:
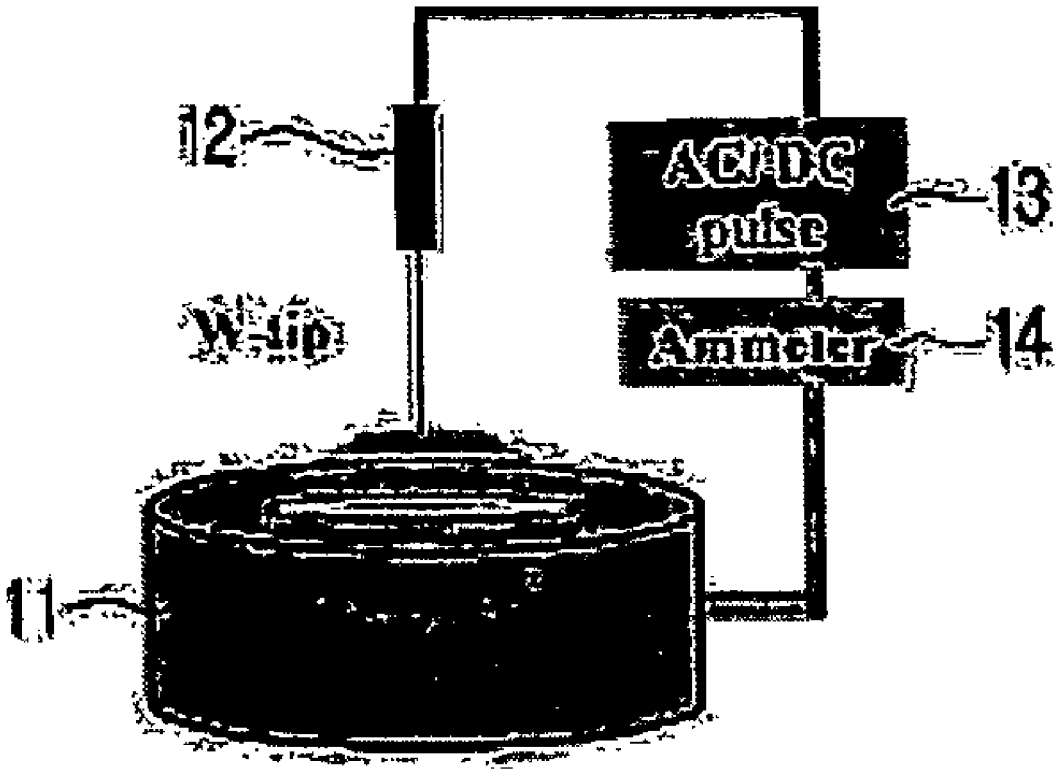
FIG. 3 is a schematic illustration of an apparatus for manufacturing a carbon-nano-tube tip according to a preferred embodiment of the present invention.
Figure 4:
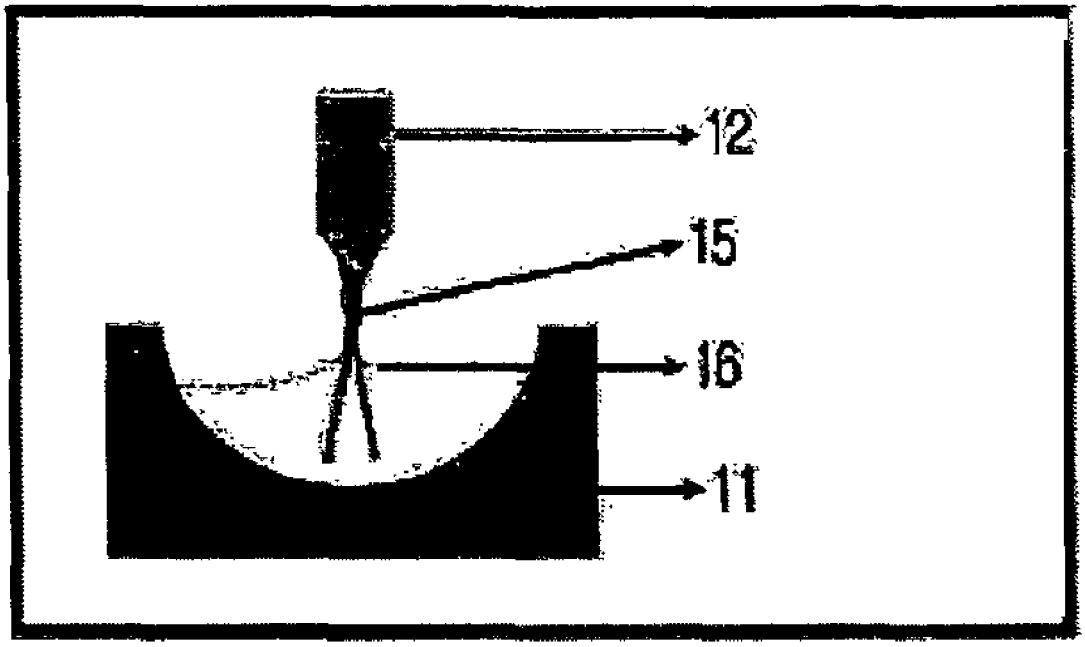
FIG. 4 is a schematic diagram showing operation mode of the apparatus according to a preferred embodiment of the present invention.

FIG. 3 illustrates a carbon nano-tube tip manufacturing apparatus (20) according to the present invention for manufacturing a carbon nano-tube tip with electrophoresis using a metallic vessel, and FIG. 4 is a diagram describing the operation of the apparatus according to the present invention using a metallic vessel as an electrode. The carbon nano-tube manufacturing apparatus (20) according to the present invention comprises an AC/DC voltage supply (13) which supplies AC and/or DC pulses; an amperemeter (14) which measures the electric current running through the circuit (13); a tungsten tip (12) which is biased by said electric voltage supply (13) and to which carbon nano-tubes (15) are attached at the of tungsten tip; and a metallic vessel (11) which is used as an electrode to said tungsten tip (12).

The metallic vessel (11) of the carbon nano-tube manufacturing apparatus (20) according to the present invention contains a carbon nano-tube solution.

A preferred process for manufacturing the carbon nano-tube solution is as follows.

First of all, the carbon nano-tubes to be used must be purified. The degree of purification should be confirmed using TGA, Raman, TEM, SEM, IR absorption analysis. The amorphous carbon layer is removed by high temperature heat treatment at atmospheric pressure in a revolving furnace. Metal is removed through acid treatment.

In the purification process, depending on the synthesis method and the types of carbon nano-tubes, the purification time, the burning temperature, and the ambient gas can be changed or the kind of acid and the acidity can be changed also. As carbon nano-tubes, thin multi-wall carbon nano-tubes and single-walled, double-walled and multi-wall carbon nano-tubes can be used.

After carbon nano-tubes through the said process are reconfirmed through TGA, a certain amount of DCE (1,2-dichloroethane) is added and a dispersed solution is made by sonicating tubes. In the dispersion process, the time and the intensity of ultrasonic treatment must be adjusted depending on the synthesis method and types of tubes. Also, besides the DCE, carbon nano-tube dispersion can be prepared by using: a non-aqueous solvent selected from the group consisting of DMF (N,N-dimethylformamide), THF (tetrahydrofuran), NMP (N-Methyl pyrrolidone), acetone and isopropyl alcohol; or an aqueous solution containing surfactant selected from the group consisting of ODA (octadecylamine), SDS (sodiumdodecylsulfate) and DNA (deoxyribonucleic acid). The organic solvent must be protected from water. The solvent can influence on the tube length at the end of tungsten tip by varying vaporization time. That is, highly volatile solution has shorter deposition time than slowly evaporating solution. Furthermore, the length of tubes can be varied depending on the degree of dispersion of carbon nano-tubes.

The CNT-solution (dispersion) is well dispersed through a centrifugation of surpernatant of CNT solution to employ almost individually dispersed tubes. Since carbon nano-tube bundles and catalysts have larger weight than individual carbon nano-tubes, most bundles and catalyst metals are removed in said centrifugation process. The rotational speed and the time of centrifugation are the variables to control the concentration and dispersion degree of carbon nano-tubes.

Next, the tungsten tip used in the present invention is etched using an electrochemical method and an electrochemically etched tip is manufactured as follows. First of all, a tungsten wire of a diameter of 0.25 mm is washed with acetone, ethanol, and deionized water. Then, after preparing a KON or NaOH aqueous solution (3M) a tungsten tip is electrochemically etched by applying a voltage. Thereafter, after it has been washed and neutralized with water and HF, it is stored in the tip box with the water removed.

Instead of metal tips that can be used here, a cantilever made of SiN, Si and the like used in Atomic Force Microscopy (AFM) or a Scanning Probe Microscope (SPM) can also be used. In addition, a semiconductor tip can be used in place of a metal tip.

Now, operation of the carbon nano-tube tip manufacturing apparatus (20) according to the present invention using a tungsten tip and carbon nano-tube solution produced through said process is described below.

A carbon nano-tube solution is dropped into a metallic vessel (11) of carbon a nano-tube manufacturing apparatus (20). Next, a voltage is supplied from an AC/DC voltage supply (13) and a tungsten tip (12) is slowly descended to the metallic vessel (11) to be placed at the surface of the carbon nano-tube dispersion solution in the metallic vessel. When tip is touching with the surface of CNT-solution, as voltage is applied to the tungsten tip (12), electric current flows on touching. At this time, the tungsten tip (12) is set and one waits until the solution dries out completely. The conditions such as the kind of organic solvent, humidity, voltage, duty ratio and the like which can influence volatility must be considered to control the tip morphology.

As shown in FIG. 4, the direction of the electric field and the level of alignment of the carbon nano-tubes can be seen when using the metallic vessel (11) having a groove inside. As illustrated in FIG. 4, when using the metallic vessel (11), a uniform and regular electric field (16) is concentrated at the center and furthermore, since the surface is lowered from volatizing organic solvent, carbon nano-tubes attached to the tip end are attracted at the center and aligned to the tip. Through this, the angle of tubes to the tungsten tip can be controlled.

Figure 2:
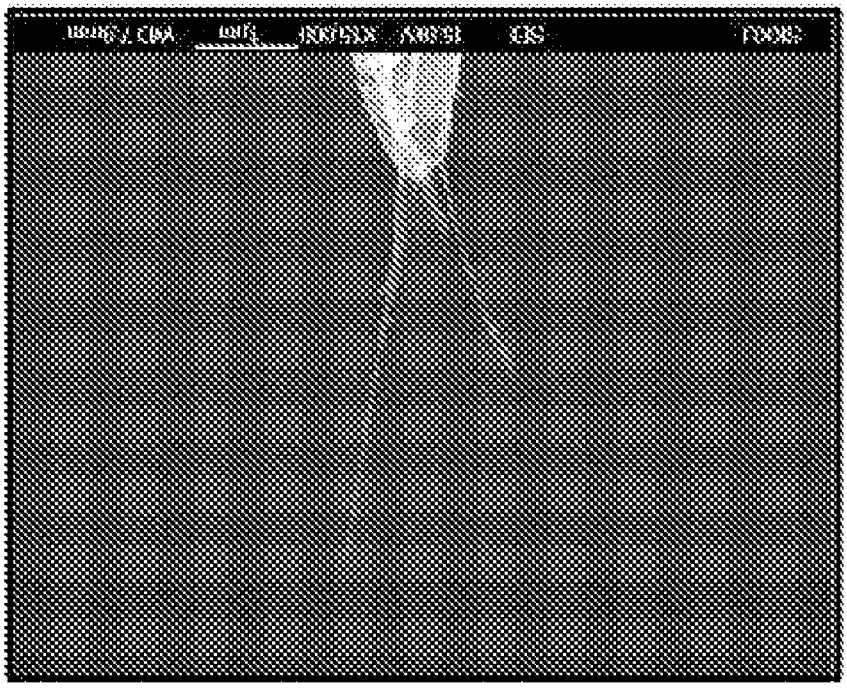
FIG. 2 is a photograph of a carbon nano-tube tip manufactured by the electrophoresis apparatus of FIG. 1.
Figure 5:
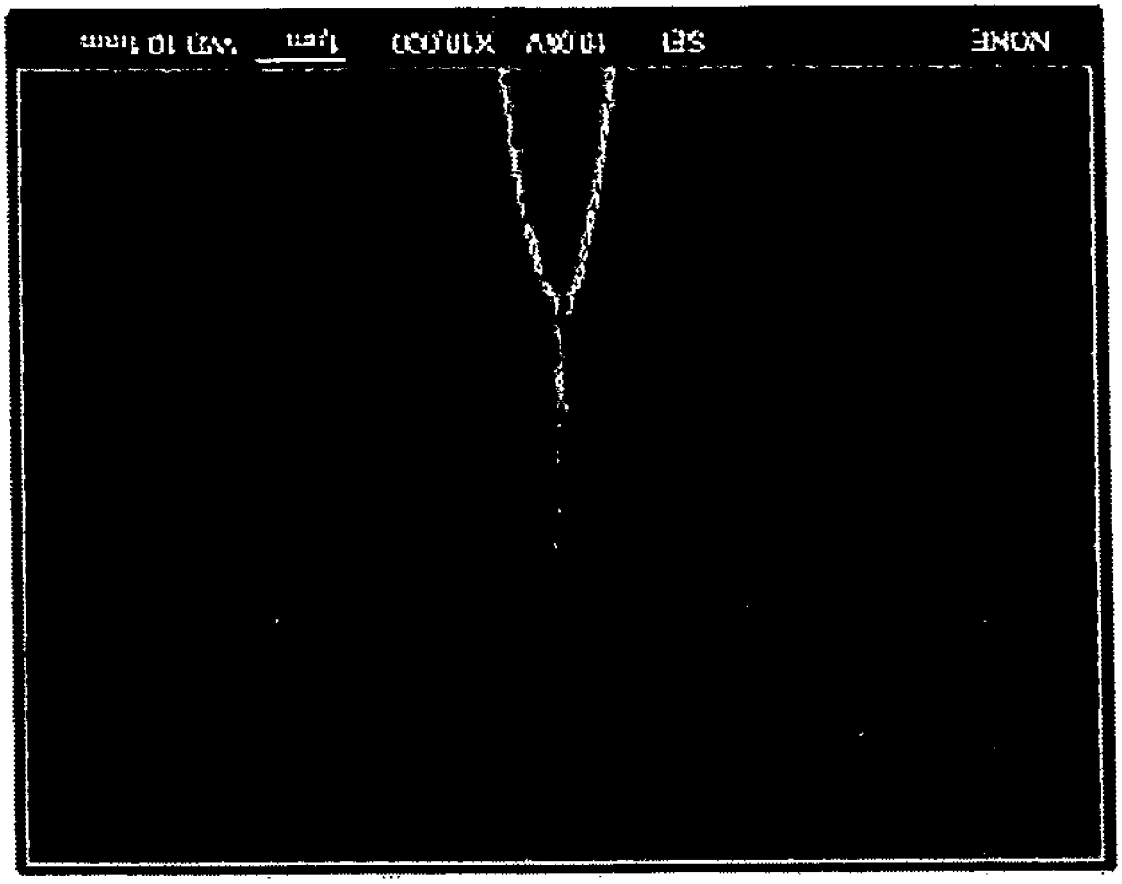
FIG. 5 is a photograph of a carbon nano-tube tip manufactured with the apparatus for manufacturing a carbon nano-tube tip of the present invention.

FIG. 5 is a photograph showing the carbon nano-tube tip manufactured using a metallic vessel according to the present invention. As shown in FIG. 5, the carbon nano-tube tip manufactured according to the present invention is formed straight in the predetermined direction. When comparing with the carbon nano-tube tip manufactured by the conventional technique shown in FIG. 2, the carbon nano-tube tip made by the present invention shows a single tip, not a multiple ones and straightly extends from the tungsten tip.

The metallic vessel used in the present invention, which has a groove inside, is so that the diameter of the inside groove must be shorter than the depth of the metallic vessel in order to supply a uniform electric field and control the direction of the carbon nano-tubes. Said metallic vessel can be preferably in the form of a hemisphere or cone, if desired.

Voltage applied in said process can be AC and DC pulses. Here, frequency and amplitude of AC voltage can be changed and duty ratio, frequency and amplitude of DC pulse can also be changed. For both AC and DC pulses, the larger the amplitude is, the greater the amount of carbon nano-tubes is attracted towards tungsten tip. In addition to amplitude, the frequency is also influential on electrophoretic deposition. Though the chance of success of attaching carbon nano-tubes to tungsten tip is considerably low under DC pulses with the duty ration less than 50%, the yield of 90% is guaranteed at least with above 80% of duty ratio.

The present invention is applicable in various ways as a method for attaching various kinds of tubes to a conductor or semiconductor tip using electrophoresis.

1. Bio-Probe

Since carbon is biologically friendly to a living body, it can be used as a probe, which can investigate biochemical reactions occurring in living cells in real time. Carbon nano-tubes, here, can be multi wall carbon nano-tubes grown by chemical vapor deposition method that have many defects on the surface.

2. Point-Emission Source

Carbon nano-tubes have a good electrical conductivity and high aspect ratio as to be a very useful material for electric emission. Especially, multi-wall carbon nano-tubes manufactured with laser vapor deposition or electric arc discharge show a good crystallinity that can contribute to highly electrical conductivity. In comparison with conventional cold cathode W tip, its voltage applied is low and a higher emission current can be drown, and the energy distribution of emitted electrons is so narrow that it can be applied to an electron gun of an electron microscope and the like.

3. Mechanical and Electrical Probe

It has such a good aspect ratio so that it can access to small objects placed in a narrow space, and it has such superior flexibility that it can be handled without impairment of the specimen. In addition, since contact resistance between either the metal or semiconductor and carbon nanotubes can be lowered through heat treatment process, carbon nano-tubes are able to work as an electrode, which can examine electrical properties of the specimen located in a very narrow space.

4. Atomic Force Microscope (AFM) Tip

By attaching carbon nano-tubes to an AFM tip, the specimen located in a narrow and deep groove can be easily analyzed.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. An apparatus for manufacturing a carbon nano-tube tip comprising:

an AC/DC voltage supply (13) for supplying AC and/or DC pulses;

a metallic or semiconductor tip (12) which is biased by the voltage supply (13) and has carbon nano-tubes (15) at its end;

an amperemeter (14) connected to said AC/DC voltage supply (13); and a metallic vessel (11) connected to the tip (12) and the amperemter (14), wherein the metallic vessel is used as an electrode and define a groove therein filled with a carbon nano-tube solution, and wherein the metallic vessel (11) is in the form of a hemisphere or a cone.

2. An apparatus according to claim 1, wherein the metallic vessel (11) is designed to have a diameter smaller than the depth of the vessel so as to be able to supply a uniform electric field during electrophoresis.

3. An apparatus according to claim 1, wherein the carbon nano-tube solution is prepared by using thin multi-wall carbon nano-tubes or single-walled, double-walled, or multi-wall carbon nano-tubes.

4. An apparatus according to claim 1, wherein the carbon nano-tube solution is prepared by using: a non-aqueous solvent selected from the group consisting of DCE (1,2-dichloroethane), DMF (N,N-dimethylformamide), THF (tetrahydrofuran), NMP (N-Methyl pyrrolidone), acetone and isopropyl alcohol; or an aqueous solution containing a surfactant selected from the group consisting of ODA (octadecylamine), SDS (sodiumdodecylsulfate) and DNA (deoxyribonucleic acid).

5. A method for manufacturing a carbon nano-tube tip comprising: dispersing carbon nano-tubes in a solvent; placing said solvent into a metallic vessel having a groove therein, wherein the metallic vessel is used as an electrode and wherein the metallic vessel is in the form of a hemisphere or a cone; and obtaining a carbon nano-tube tip by attaching the carbon nano-tubes by electrophoresis to the end of a metal tip or semiconductor tip.

6. A method for manufacturing a carbon nano-tube tip comprising:

providing carbon nano-tubes in a metallic vessel to prepare a carbon nano-tube solution, wherein the metallic vessel is used as an electrode and wherein the metallic vessel is in the form of a hemisphere or a cone;

supplying AC and DC pulses to a metal or semiconductor tip using an AC/DC voltage supply;

placing the tip on the surface of the carbon nano-tube solution in the metallic vessel;

controlling the angle between the tip and the surface of the carbon nano-tube solution; and attaching the carbon nano-tubes to the end of the tip.

7. The method of claim 5, wherein the metallic vessel is designed to have a diameter smaller than the depth of the vessel.

8. The method of claim 5, wherein the carbon nano-tubes are thin multi-wall carbon nano-tubes, or single-walled, double-walled, or multi-wall carbon nano-tubes.

9. The method of claim 5, wherein the solvent is a non-aqueous solvent selected from the group consisting of DCE (1,2-dichloroethane), DMF (N,N-dimethylformamide), THF (tetrahydrofuran), NMP (N-Methyl pyrrolidone), acetone and isopropyl alcohol; or an aqueous solution containing a surfactant selected from the group consisting of ODA (octadecylamine), SDS (sodiumdodecylsulfate) and DNA (deoxyribonucleic acid).

* * * * *